US010695688B2

(12) United States Patent
Choi

(10) Patent No.: US 10,695,688 B2
(45) Date of Patent: Jun. 30, 2020

(54) POWER TRANSMISSION APPARATUS AND BUILT-UP TYPE TOY INCLUDING THE SAME

(71) Applicant: UNITRUST DEVELOPMENT CO., LTD., Busan (KR)

(72) Inventor: Young-Seung Choi, Busan (KR)

( * ) Notice: Subject to any disclaimer, the term of this patent is extended or adjusted under 35 U.S.C. 154(b) by 27 days.

(21) Appl. No.: 15/114,255

(22) PCT Filed: Jan. 19, 2015

(86) PCT No.: PCT/KR2015/000512

§ 371 (c)(1),
(2) Date: Jul. 26, 2016

(87) PCT Pub. No.: WO2015/111883

PCT Pub. Date: Jul. 30, 2015

(65) Prior Publication Data

US 2017/0007939 A1 Jan. 12, 2017

(51) Int. Cl.

| | |
|---|---|
| ***A63H 33/04*** | (2006.01) |
| ***A63H 31/00*** | (2006.01) |
| ***A63H 29/22*** | (2006.01) |
| ***A63H 33/00*** | (2006.01) |
| ***A63H 33/08*** | (2006.01) |

(52) U.S. Cl.

CPC ..... *A63H 33/042* (2013.01); *A63H 29/22* (2013.01); *A63H 31/00* (2013.01); *A63H 33/005* (2013.01); *A63H 33/088* (2013.01)

(58) Field of Classification Search

CPC ..... A63H 33/042; A63H 31/00

See application file for complete search history.

(56) References Cited

U.S. PATENT DOCUMENTS 1,763,302 A * 6/1930 Gilbert ..... A63H 33/042 446/90
4,109,398 A * 8/1978 Hida ..... A63H 31/00 434/370
4,214,402 A * 7/1980 Ogawa ..... A63H 17/002 446/90
4,599,077 A * 7/1986 Vuillard ..... A63H 17/002 446/124
4,712,184 A * 12/1987 Haugerud ..... B25J 5/007 377/16

(Continued)

*Primary Examiner* — Eugene L Kim
*Assistant Examiner* — Alyssa M Hylinski
(74) *Attorney, Agent, or Firm* — Antonio Ha & U.S. Patent, LLC

(57) ABSTRACT

The present invention relates to a power transmission apparatus for transmitting power between components, and a built-up type toy including the same. The power transmission apparatus comprises: a housing having an operating space formed therein; a connection hole that is open in at least one direction of the housing; a gear assembly that operates in the operating space of the housing and has a connecting link on one end thereof which is exposed to the outside through the connection hole; and a coupling tube for selectively interconnecting two connection holes of the power transmission apparatus and a counterpart power transmission apparatus connected thereto, wherein the connecting link of the power transmission apparatus and a counterpart connecting link are connected and interworked with each other in the interior of the coupling tube.

14 Claims, 18 Drawing Sheets

(56) References Cited

U.S. PATENT DOCUMENTS

| | | | | | |
|---|---|---|---|---|---|
| 4,813,903 | A * | 3/1989 | Furukawa | A63H 33/042 | 446/103 |
| 5,259,803 | A * | 11/1993 | Lyman | A63H 31/00 | 446/103 |
| 5,411,428 | A * | 5/1995 | Orii | A63H 33/042 | 446/102 |
| 5,645,463 | A * | 7/1997 | Olsen | A63H 33/04 | 446/104 |
| 5,779,515 | A * | 7/1998 | Chung | A63H 33/04 | 446/102 |
| 5,823,843 | A * | 10/1998 | Pohlman | A63H 33/101 | 446/108 |
| 5,890,943 | A * | 4/1999 | Poulsen | A63H 33/042 | 446/103 |
| 5,919,072 | A * | 7/1999 | Pohlman | A63H 17/002 | 446/120 |
| 6,315,628 | B1 * | 11/2001 | Quercetti | A63H 33/04 | 446/103 |
| 6,561,866 | B1 * | 5/2003 | Lee | A63H 33/042 | 446/103 |
| 2004/0259466 | A1 * | 12/2004 | Maxwell | A63H 33/042 | 446/487 |
| 2013/0012098 | A1 * | 1/2013 | Meys | A63H 33/062 | 446/85 |
| 2014/0220858 | A1 * | 8/2014 | Bruder | A63H 17/12 | 446/468 |
| 2017/0288976 | A1 * | 10/2017 | Wang | A63H 33/062 | |

* cited by examiner

POWER TRANSMISSION APPARATUS AND BUILT-UP TYPE TOY INCLUDING THE SAME

TECHNICAL FIELD

The present disclosure relates to a power transmission apparatus, and more particularly, to a power transmission apparatus for transmitting power between components and a built-up type toy using the same.

BACKGROUND ART

In general, a power transmission apparatus including a plurality of components coupled to each other has various types of power transmission structures. Such a power transmission apparatus is used in various fields such as a built-up type toy which must be easily assembled and disassembled.

The built-up type toy refers to a toy which includes various shapes of components which are assembled or disassembled for fun by a user. The built-up type toy may be formed of various materials such as paper, wood, metal and plastic. According to the assembling method, the built-up type toy may be divided into a toy of which components are bonded through an adhesive and a toy of which components are fitted to each other or assembled through a magnet without an adhesive.

Among such built-up type toys, toys which are actually activated through power such as torque of a motor may improve a learning effect while a plurality of components interwork with each other through a power transmission apparatus.

The power transmission apparatus is assembled through a gear or belt such that plurality of components interwork with each other. However, since the assembling operation is a relatively delicate operation, it is not easy for young users to perform the assembling operation.

Thus, there is a demand for a power transmission apparatus which can be relatively easily assembled and stably transmit power, and a built-up type toy including the same.

DISCLOSURE

Technical Problem

Various embodiments are directed to a power transmission apparatus which is capable of enabling a user to easily assemble components for transmitting power, and a built-up type toy including the same.

Also, various embodiments are directed to a power transmission apparatus which is capable of stably transmitting power between components and enabling a user to check a power transmission process with the naked eye, and a built-up type toy including the same.

Technical Solution

In an embodiment, a power transmission apparatus for transmitting power between components may include: a housing having an operating space formed therein; a connection hole opened in one or more directions of the housing; a gear assembly operated in the operating space of the housing, and having a connecting link installed at one end thereof, the connecting link being exposed to the outside through the connection hole; and a coupling tube for selectively coupling two connection holes of the power transmission apparatus and a counterpart power transmission apparatus connected thereto. The connecting link of the power transmission apparatus may be connected and interworked with a counterpart connecting link within the coupling tube.

The housing may have a connection protrusion portion formed thereon, the connection hole may be formed in the connection protrusion portion, and the coupling tube may be coupled to cover the outer surface of the connection protrusion portion.

The coupling tube may have a press-fitting rib formed on the inner surface thereof.

The housing and the gear assembly may be formed of a transparent material.

The housing may be formed in a hemispherical shape, and the connection protrusion portion may be formed in two or more directions of the front, rear, left and right directions and the upward and downward directions, while forming a pair.

The operating space may have an inner housing installed therein so as to fix a gear shaft constituting the gear assembly.

The gear assembly may include any one of an extending gear, a direction change gear, a speed change gear and a direction/speed change gear.

The extending gear may include: a rotating shaft having both ends extended toward connection holes of the housing, the connection holes facing each other; and a connecting link installed at both ends of the rotating shaft.

The direction change gear may include: a pair of driving gear parts installed in connection holes of the housing, the connection holes facing each other; and a driven gear part engaged with the pair of driving gear parts, and having a rotating shaft perpendicular to the pair of driving gear parts, and the rotating shaft of the driven gear part is extended in a direction perpendicular to a virtual extension line connecting the pair of driving gear parts, such that both ends thereof are extended toward separate connection holes.

The speed change gear may include: a first gear part; a second gear part engaged and rotated with the first gear part; and a third gear part having gear teeth formed along the inner circumferential surface thereof such that the second gear part is inscribed in the third gear part. The first gear part may be extended to any one connection hole of the housing, and the third gear part is extended to the opposite connection hole facing the connection hole.

The speed change gear may include a plurality of speed change gear parts, the speed change gear parts may include a first operating part having a relatively large diameter and a second operating part having a relatively small diameter and rotating with the first rotating part, and the first operating part of the speed change gear may be engaged and rotated with a second operating part of a counterpart speed change gear which is engaged with the speed change gear.

The speed/direction change gear may include: a worm gear part extended in one direction, and having both ends extended to a pair of connection holes facing each other; a direction change gear part installed in each of both connection holes in a direction perpendicular to the worm gear part; and a connecting gear part divided into two parts which have different diameters and are engaged with the worm gear part and the direction change gear part such that the worm gear part and the direction change gear interwork with each other.

Advantageous Effects

The power transmission apparatus and the built-up type toy according to the embodiment of the present invention can have the following effect.

The power transmission apparatus for transmitting power includes one independent housing and has a change direction or deceleration function. Thus, since the power transmission apparatuses can be simply coupled to implement various functions and applications, even young users can easily create a power transmission structure, which makes it possible to improve the range of utilization.

Furthermore, since the gear structure installed in the transparent housing of the power transmission apparatus can be checked with the naked eye, a user can easily understand the movement of the gear structure. Thus, the learning effect can be improved.

Moreover, two different power transmission apparatuses can be easily coupled to each other through two connecting links installed therein, and the two connecting links can be smoothly and stably rotated through the coupling tube covering the connecting links. Thus, the operation reliability can be improved.

Furthermore, since the housing and the gear assembly are injection-molded, the assemblability can be improved, and noise can be reduced during an operating process.

Moreover, since the gear assembly is fixed by the inner housing, the gear assembly can be stably operated without a gap, and noise can be further reduced during an operating process.

BEST MODE FOR INVENTION

A power transmission apparatus for transmitting power between components may include a housing having an operating space formed therein; a connection hole opened in one or more directions of the housing; and a gear assembly operated in the operating space of the housing, and having a connecting link installed at one end thereof, the connecting link being exposed to the outside through the connection hole. The connecting link of the power transmission apparatus may be connected and interworked with a counterpart connecting link through the connection hole, and the housing may include first and second housings which are symmetrical with each other and coupled to each other.

Furthermore, a built-up type toy including a power transmission apparatus may include: a driving device; a power transmission apparatus connected to the driving device so as to transmit power; and a rotating part rotated by the power transmission apparatus connected thereto. The driving device may have a motor to generate torque, and the power transmission apparatus may receive the torque of the driving device and transmits the received torque to the rotating part. The power transmission apparatus may include: a housing having an operating space formed therein; a connection hole opened in one or more directions of the housing; and a gear assembly operated in the operating space of the housing, and having a connecting link installed at one end thereof, the connecting link being exposed to the outside through the connection hole. The housing may include first and second housings which are symmetrical with each other and coupled to each other.

MODE FOR INVENTION

Hereafter, a power transmission apparatus and a built-up type toy including the same according to an embodiment of the present invention will be described in detail with reference to the accompanying drawings.

The power transmission apparatus C according to the embodiment of the present invention may serve to transmit power between components, and have a direction change function or acceleration/deceleration function.

The power transmission apparatus C has an independent housing 110, and the independent housings 110 may be simply coupled to each other so as to easily implement a direction change function or deceleration function.

Figure 1A:
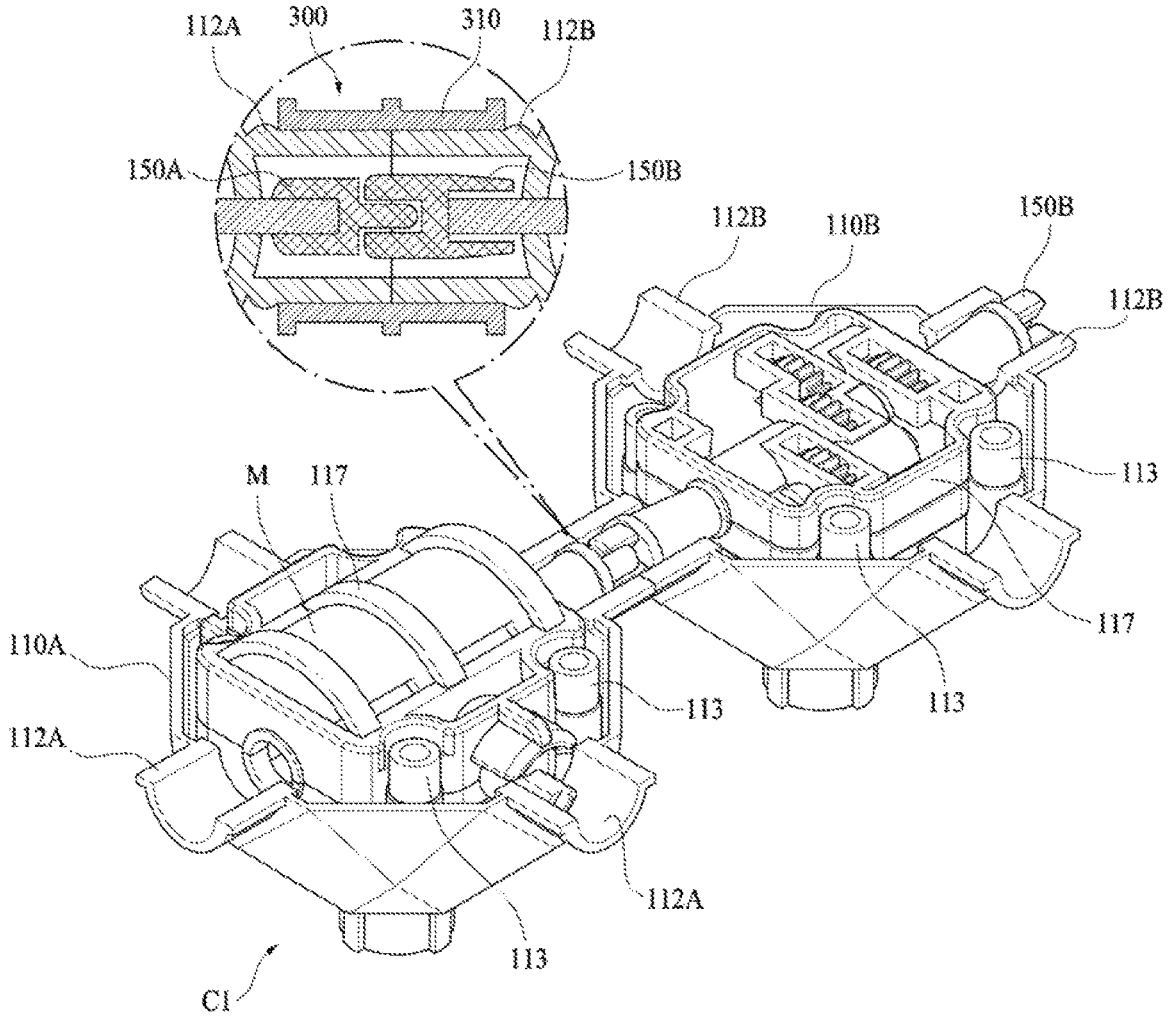
FIG. 1A is a perspective view of a power transmission apparatus according to an embodiment of the present invention.
Figure 1B:
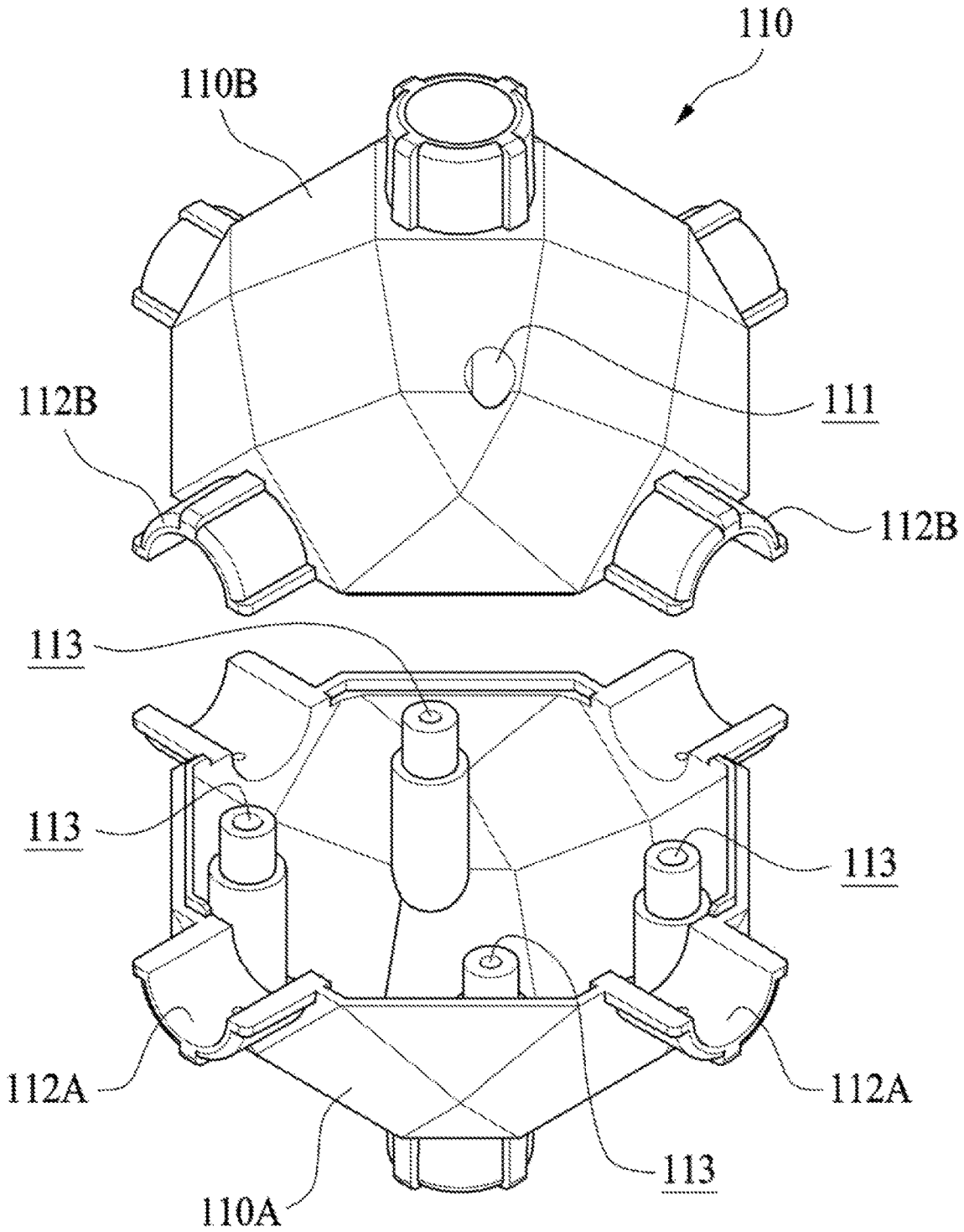
FIG. 1B is an exploded perspective view of a housing constituting the embodiment of the present invention.

FIG. 1A is a perspective view of a power transmission apparatus C according to an embodiment of the present invention, and FIG. 1B is an exploded perspective view of a housing 110 constituting the embodiment of the present invention.

As illustrated in FIGS. 1A and 1B, the power transmission apparatus C according to the embodiment of the present invention includes the housing 110 which has an operating space formed therein and forms the frame of the power transmission apparatus C. As illustrated in FIGS. 1A and 1B, the housing 110 may be formed in a substantially spherical shape, and have an operating space formed therein. Desirably, the housing 110 may be formed of a transparent or translucent material through which the operating space can be observed.

As illustrated in FIGS. 1A and 1B, the housing 110 includes a first housing 110A and a second housing 110B. The first and second housings 110A and 110B have fastening holes 113 formed at positions corresponding to each other, and are coupled to each other through fasteners (not illustrated) inserted into the fastening holes 113.

At this time, the housing 110 has an insertion hole 111 formed on the outer surface thereof, and the insertion hole 111 communicates with the fastening hole 113 such that a fastener can be inserted into the fastening hole 113 through the insertion hole 111.

In the operating space, a gear assembly 200 to be described below is installed. According to the type (function) of the gear assembly 200, the type of the power transmission apparatus C may be changed.

The housing 110 has a connection hole (with no reference numeral) opened in one or more directions. In the present embodiment, the connection hole through which the operating space is opened to the outside is formed in the front, rear, left and right directions and the upward and downward directions of the housing 110.

In the present embodiment, a pair of connection holes are formed in each two directions having a virtual straight path, and each of the connection holes is formed through a connection protrusion portion 112 protruding from the housing 110.

The housing 110 may be constituted by coupling two components. FIGS. 7 and 8 illustrate that one of the two components is omitted to expose the operating space.

In the operating space of the housing 110, the gear assembly 200 is installed. The gear assembly 200 is operated in the operating space, and a connecting link 150 formed at one end of the gear assembly 200 is exposed to the outside through the connection hole and coupled to a connecting link 150 of a counterpart power transmission apparatus C, such that the power transmission apparatuses interwork with each other. The gear assembly 200 will be described below in more detail.

Figure 3A:
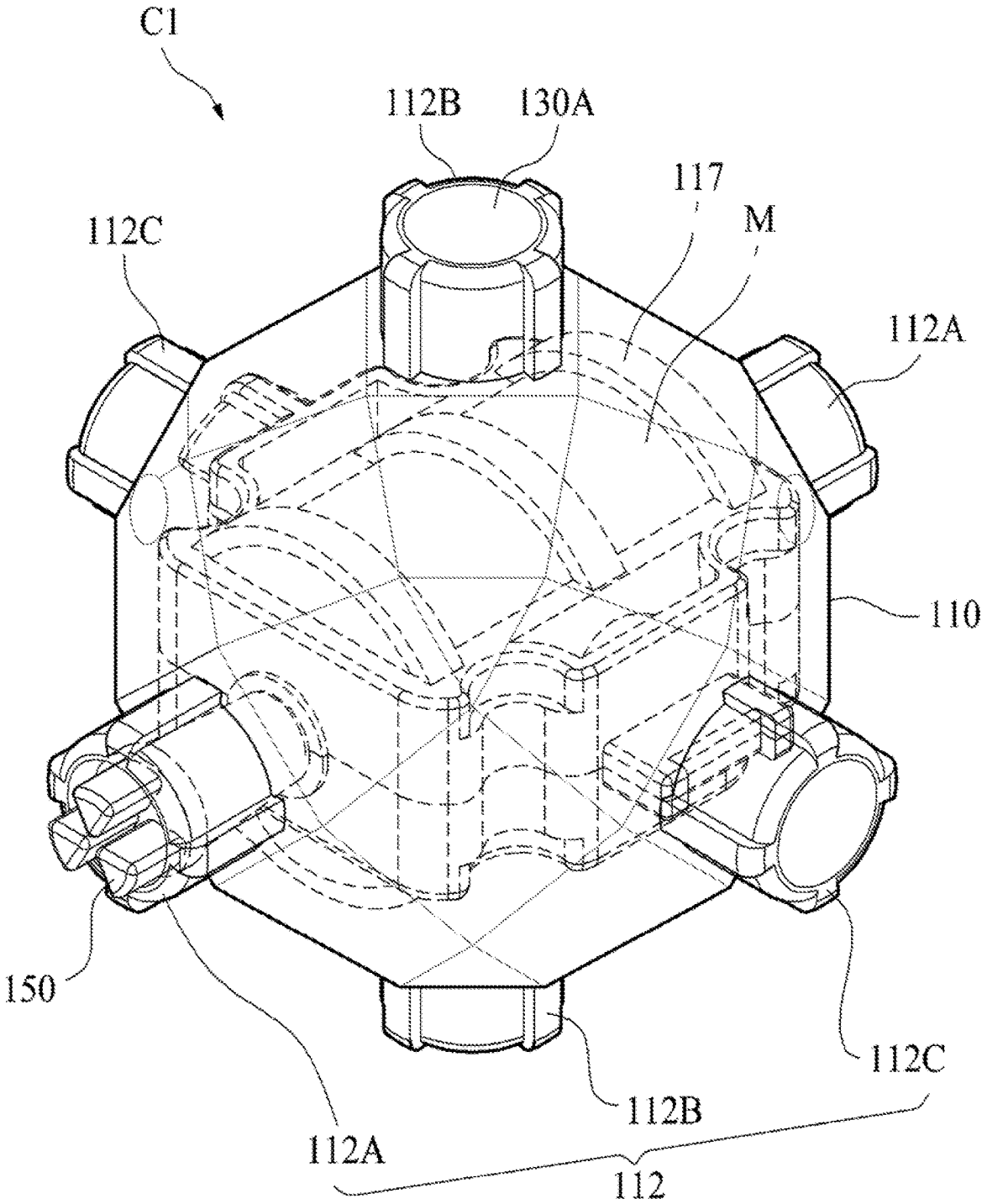
FIGS. 3A and 3B are perspective views of a driving device constituting the embodiment of the present invention.
Figure 3B:
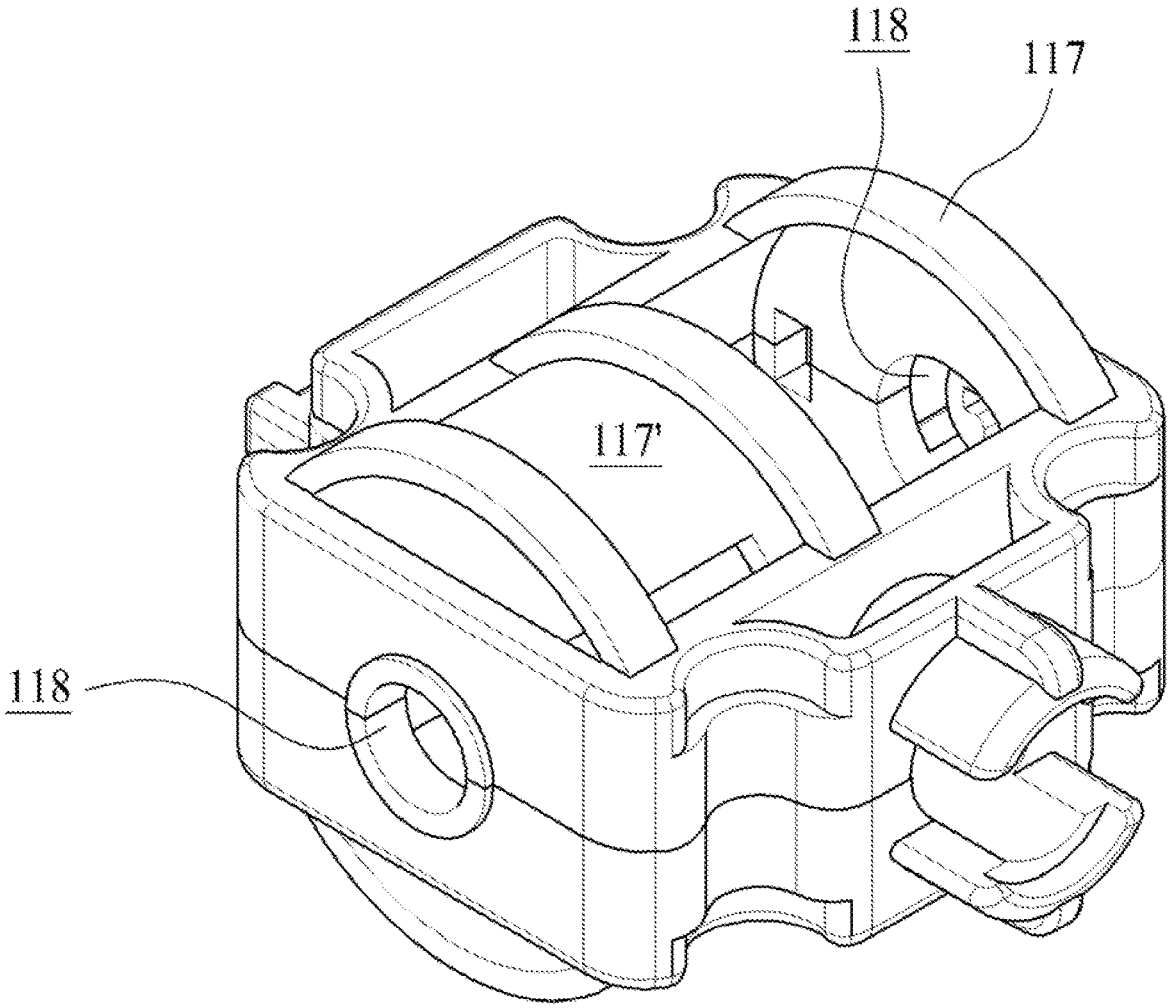

As illustrated in FIG. 1A, the power transmission apparatuses C may be coupled to each other so as to interwork with each other. As the two power transmission apparatuses C are coupled to each other, the gear assemblies 200 installed in the respective power transmission apparatuses C interwork with each other. FIG. 1A illustrates that a driving device C1 and a power transmission apparatus C6 are coupled to each other. The driving device C1 has the same housing 110 as the power transmission apparatus C6, but includes a power unit such as a motor M, in place of the gear assembly 200. The configuration of the driving device C1 is illustrated in more detail in FIG. 3.

At this time, the power transmission apparatuses C are coupled through a coupling tube 300. The coupling tube 300 selectively couples two connection holes of the power transmission apparatus C and the counterpart power transmission apparatus C, and the connecting link 150 of the power transmission apparatus C and the counterpart connecting link 150 are connected to each other within the coupling tube 300 so as to interwork with each other.

Figure 2:
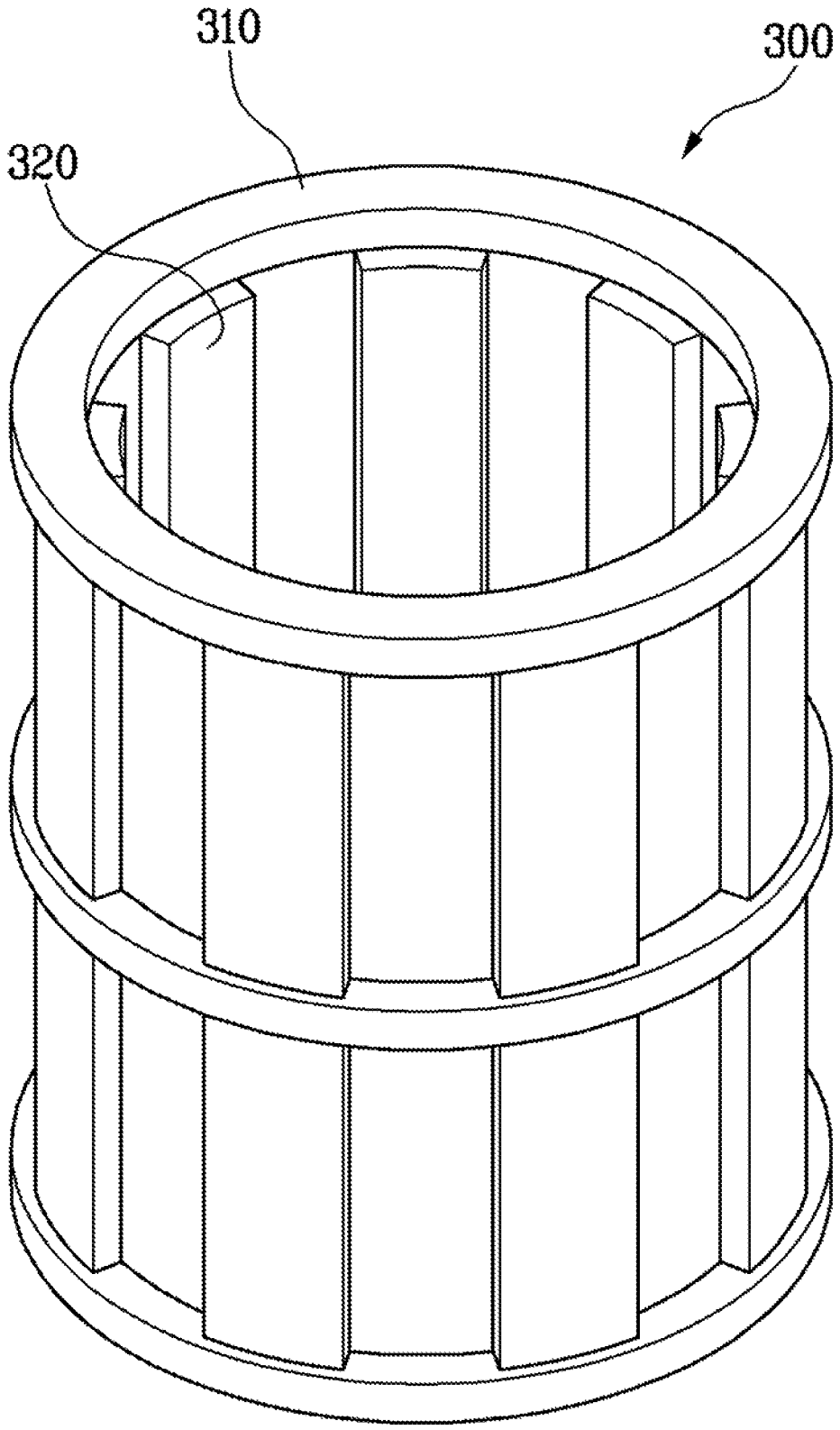
FIG. 2 is a perspective view of a coupling tube constituting the embodiment of the present invention.

The coupling tube 300 is coupled to cover the outer surface of the connection protrusion portion 112. As illustrated in FIG. 2, the coupling tube 300 may have press-fitting ribs 320 protruding from the inner surface thereof. Thus, the connection protrusion portion 112 may be reliably press-fitted and fixed to the inside of the coupling tube.

As illustrated in FIG. 1A, an inner housing 117 constituting the gear assembly 200 may be installed in the operating space so as to fix and protect the gear assembly 200. When the gear assembly 200 includes a plurality of components, the inner housing 117 may stably support the components in the operating space.

As illustrated in an expanded cross-sectional view of FIG. 1A, the connecting link 150 constituting the gear assembly 200 includes a plurality of elastic fingers 150' (refer to FIG. 3A), and the elastic fingers 150' are coupled to elastic fingers 150' of the counterpart connecting link 150 through elastic deformation.

Hereafter, a variety of power transmission apparatuses according to the functions of gear assemblies will be sequentially described with reference to the accompanying drawings.

For convenience of description, the power transmission apparatuses C are represented by separate symbols C2 to C6, respectively.

Figure 4A:
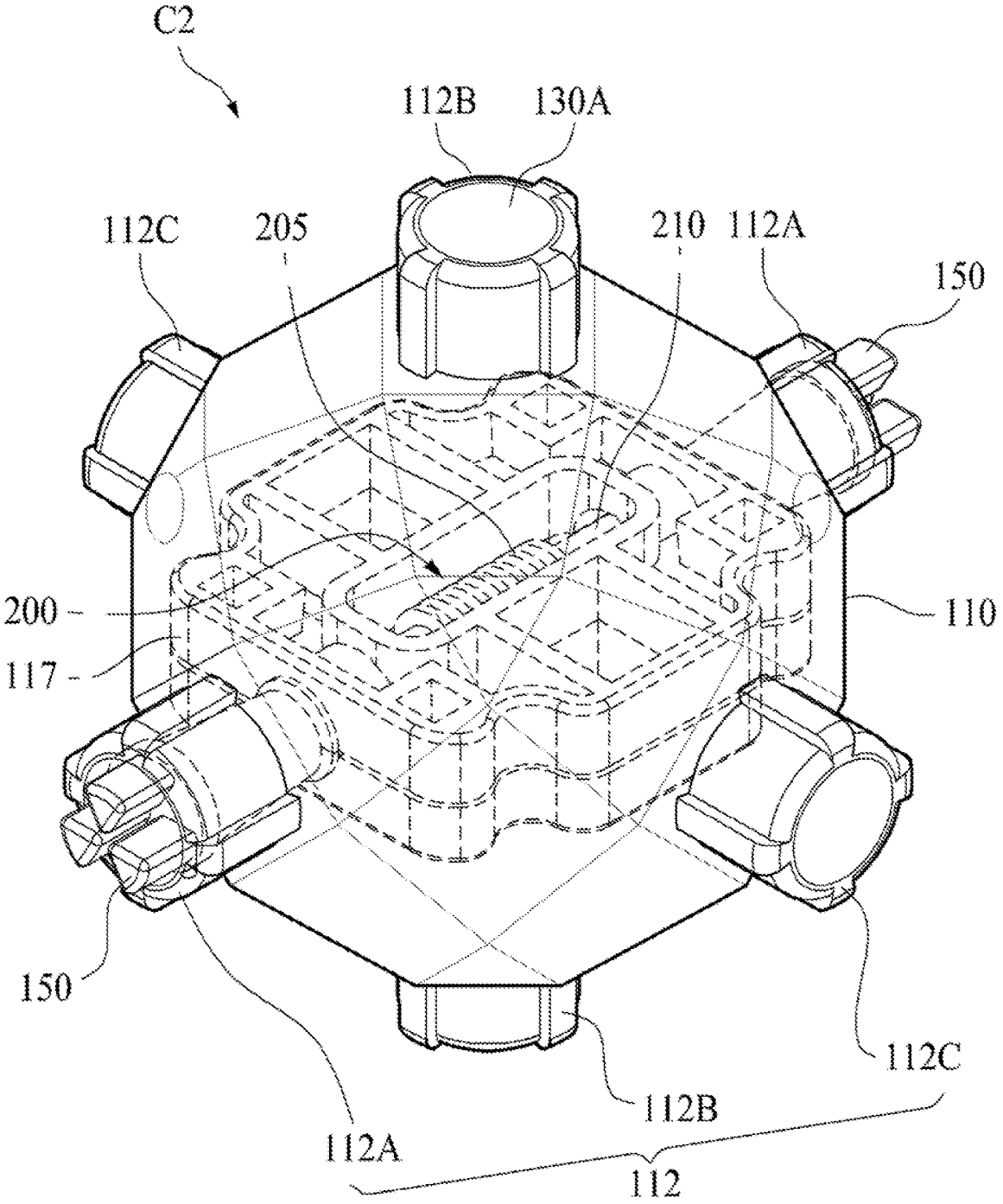
FIGS. 4A and 4B are perspective views of a power transmission apparatus to which an extending gear is applied, among the power transmission apparatuses according to the embodiment of the present invention.
Figure 4B:
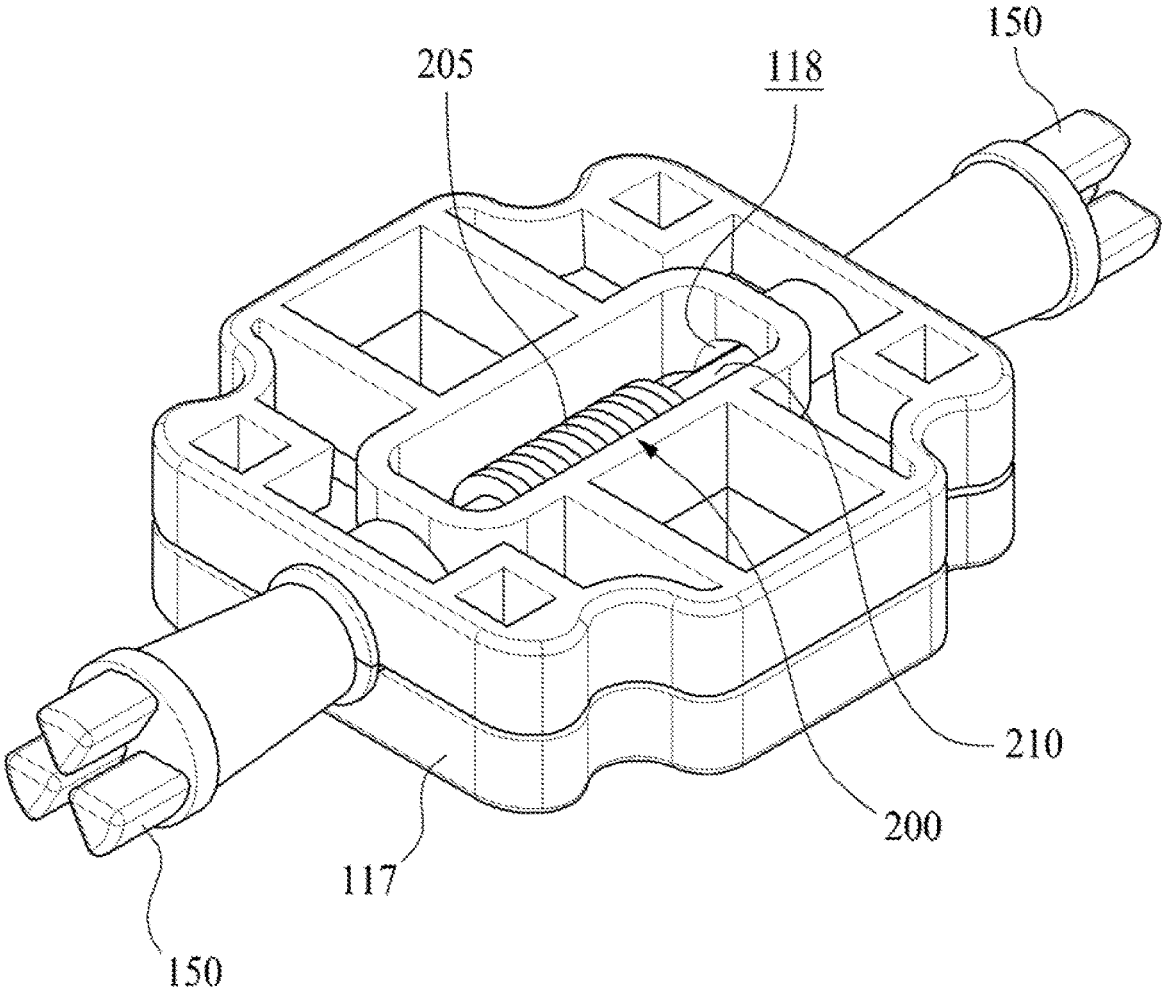

FIGS. 4A and 4B are perspective views of a power transmission apparatus C2 to which an extending gear is applied, among the power transmission apparatuses C according to the embodiment of the present invention.

The gear assembly 200 of the power transmission apparatus C2 includes an extending gear which serves to extend a distance between two power transmission apparatuses C2. More specifically, the extending gear includes a rotating shaft 210 and a connecting link 150. The rotating shaft 210 has both ends extended toward connection holes of the housing 110, which face each other, and the connecting link 150 is installed at both ends of the rotating shaft 210.

The extending gear only serves to simply transmit power to a separate position without acceleration/deceleration or change of direction.

The extending gear and the rotating shaft 210 may be fixed to an inner housing 117, and stably operated. Reference numeral 118 represents a through-hole through which the rotating shaft 210 passes.

Figure 5A:
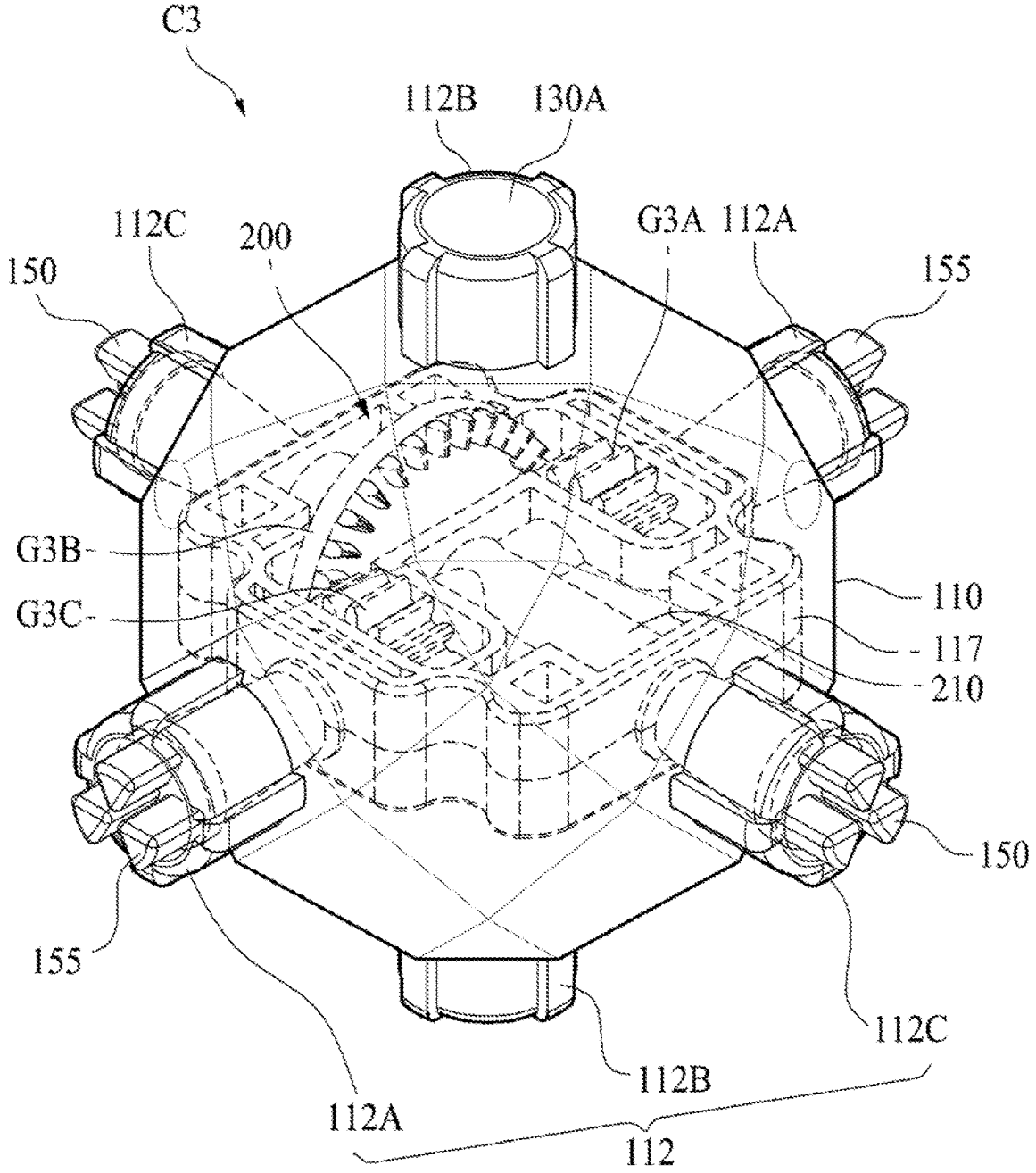
FIGS. 5A to 5C are perspective views of a power transmission apparatus to which a direction change gear is applied, among the power transmission apparatuses according to an embodiment of the present invention.
Figure 5B:
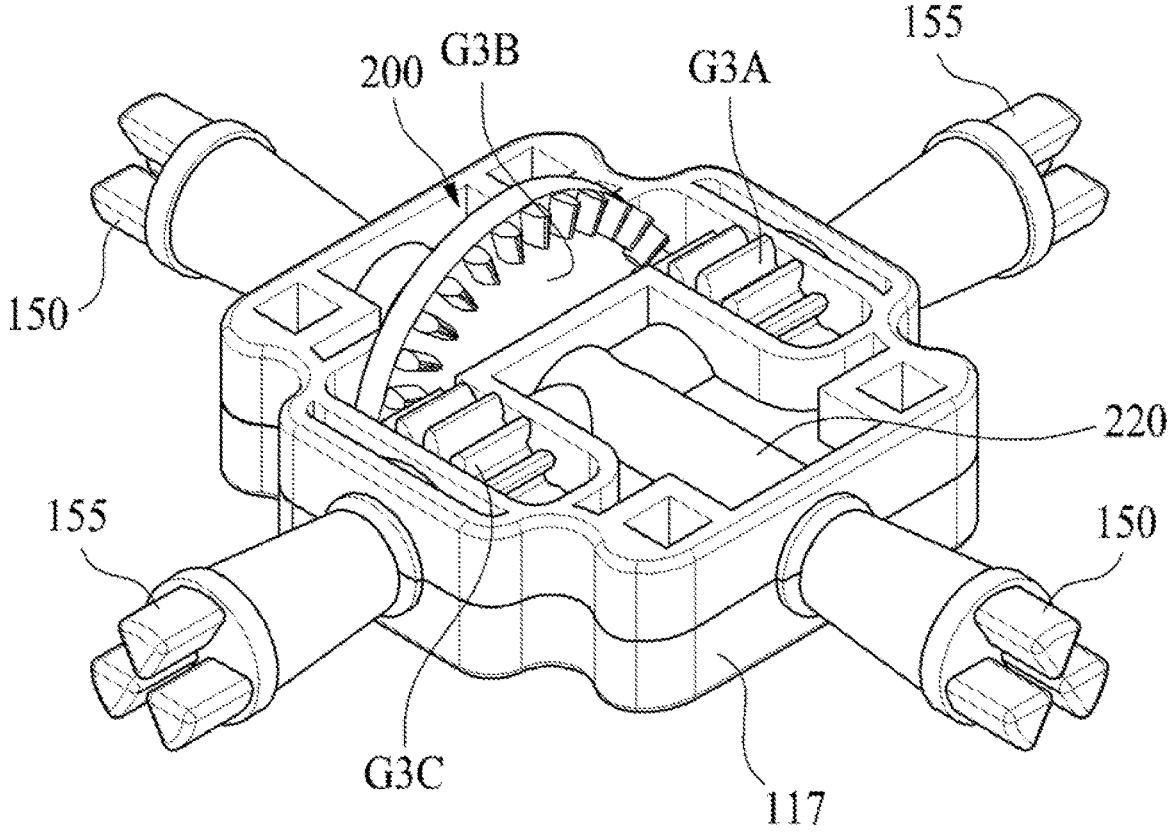
Figure 5C:
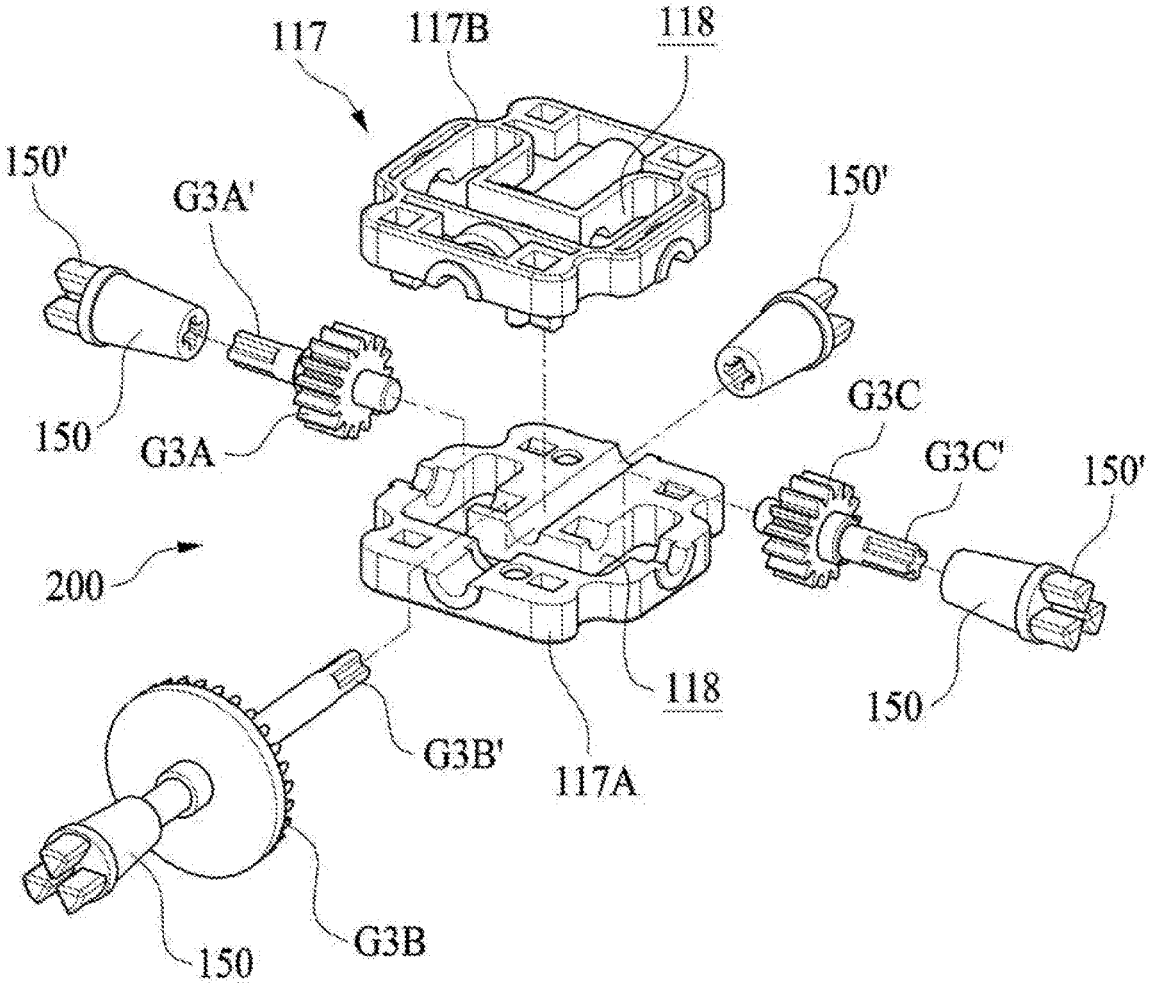

FIGS. 5A to 5C are perspective views of a power transmission apparatus C3 to which a direction change gear is applied, among the power transmission apparatuses C according to an embodiment of the present invention.

The gear assembly 200 of the power transmission apparatus C3 includes a direction change gear which serves to change the direction of transmitted power to a direction perpendicular thereto.

More specifically, the direction change gear includes a pair of driving gear parts G3A and G3C and a driven gear part G3B. The pair of driving gear parts G3A and G3C are installed in connection holes of the housing 110, which face each other, respectively, and the driven gear part G3B is engaged with the pair of driving gear parts G3A and G3C and has a rotating shaft perpendicular to the pair of driving gear parts G3A and G3C.

The rotating shaft 220 of the driven gear part G3B may be extended in a direction perpendicular to a virtual extension line connecting the pair of driving gear parts G3A and G3C, and both ends of the rotating shaft 229 may be extended toward separate connection holes at positions corresponding to a connection protrusion portion 112C in FIG. 5A, in order to change the direction. The driven gear part G3B and the driving gear parts G3A and G3C may be implemented with a helical gear to change the direction.

As illustrated in FIG. 5C, the inner housing 117 includes first and second inner housings 117*a* and 117*b* coupled to each other with the gear assembly 200 interposed therebetween, and each of the first and second inner housings 117*a* and 117*b* has a gear seating part 118 in which the gear assembly 200 can be seated.

The driving gear parts G3A and G3C and the driven gear part G3B, which constitute the gear assembly 200, have coupling protrusions G3A', G3B' and G3C' formed at one ends thereof, and are coupled to the connecting links 150, respectively.

Figure 6A:
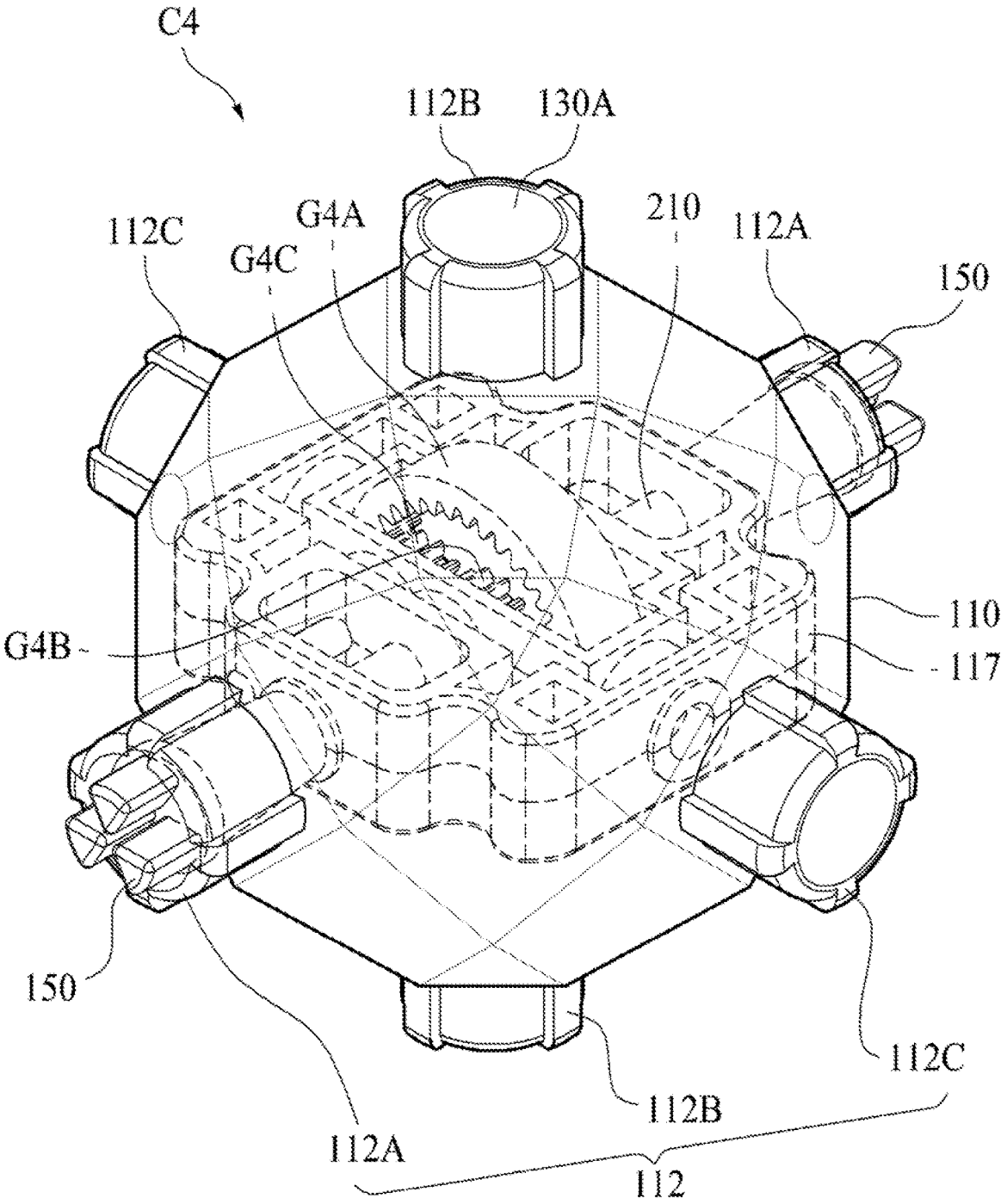
FIGS. 6A and 6B are perspective views of a power transmission apparatus to which a speed change gear is applied, among the power transmission apparatuses according to the embodiment of the present invention.
Figure 6B:
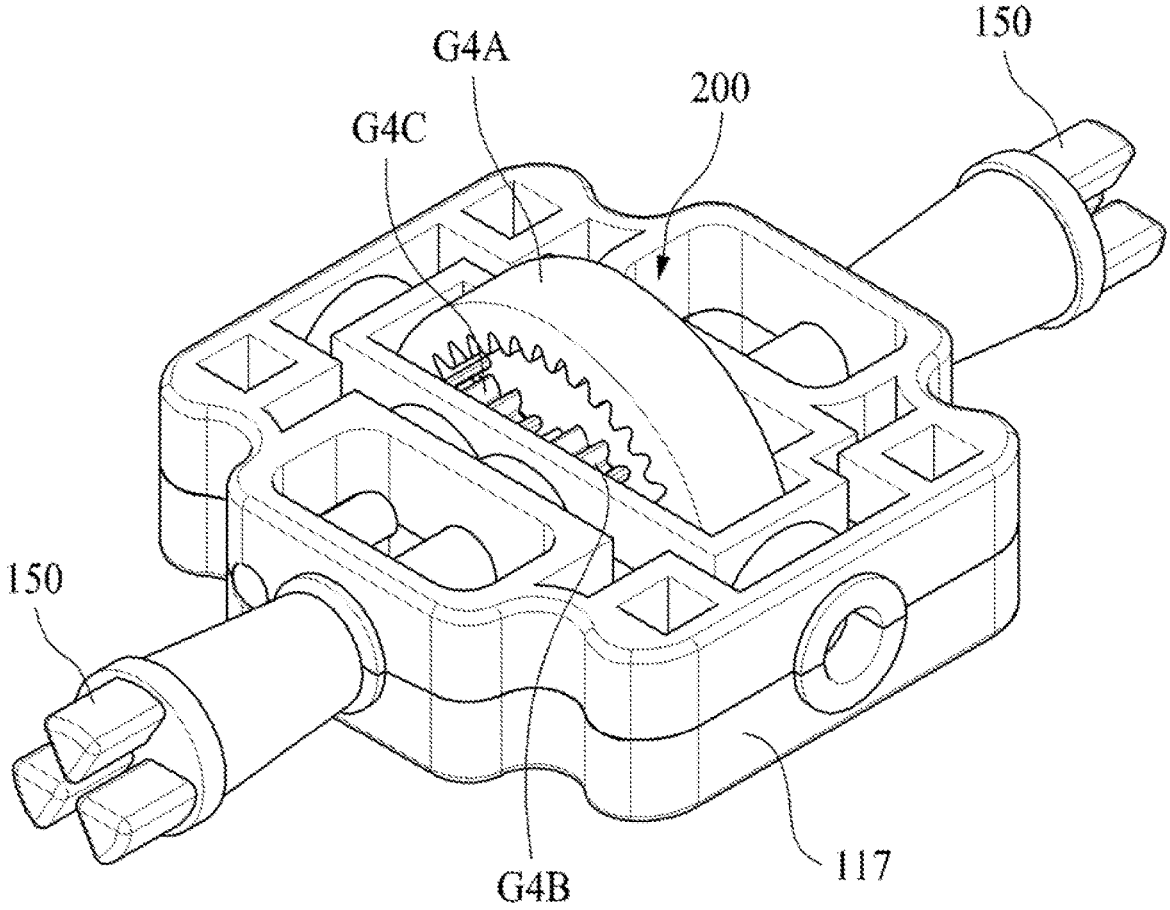

FIGS. 6A and 6B are perspective views of a power transmission apparatus C4 to which a speed change gear is applied, among the power transmission apparatuses C according to the embodiment of the present invention.

The gear assembly 200 of the power transmission apparatus C4 includes a speed change gear which serves to raise or lower the speed of transmitted power.

More specifically, the speed change gear includes a first gear part G4A, a second gear part G4C and a third gear part G4B. The second gear part G4C is engaged and rotated with the first gear part G4A, and the third gear part G4B has gear teeth formed along the inner circumference thereof such that the second gear part G4C is inscribed therein.

That is, the second gear part G4C is rotated by the first gear part G4A, and the third gear part G4B having a larger than the first and second gear parts G4A and G4C is rotated by the second gear part G4C, thereby lowering the speed of power.

At this time, the second gear part G4C is inscribed in the third gear part G4B, and the second gear part G4C serves to transmit power of the first gear part G4A to the third gear part G4B.

Furthermore, as the first gear part G4A is extended to any one connection hole of the housing 110 and the third gear part G4B is extended to the other connection hole facing the one connection hole, power transmitted from another power transmission apparatus C may be transmitted to still another power transmission apparatus C.

When the direction of the power transmission apparatus C4 is changed, the speed change gear performs an acceleration function, instead of the deceleration function.

Figure 7A:
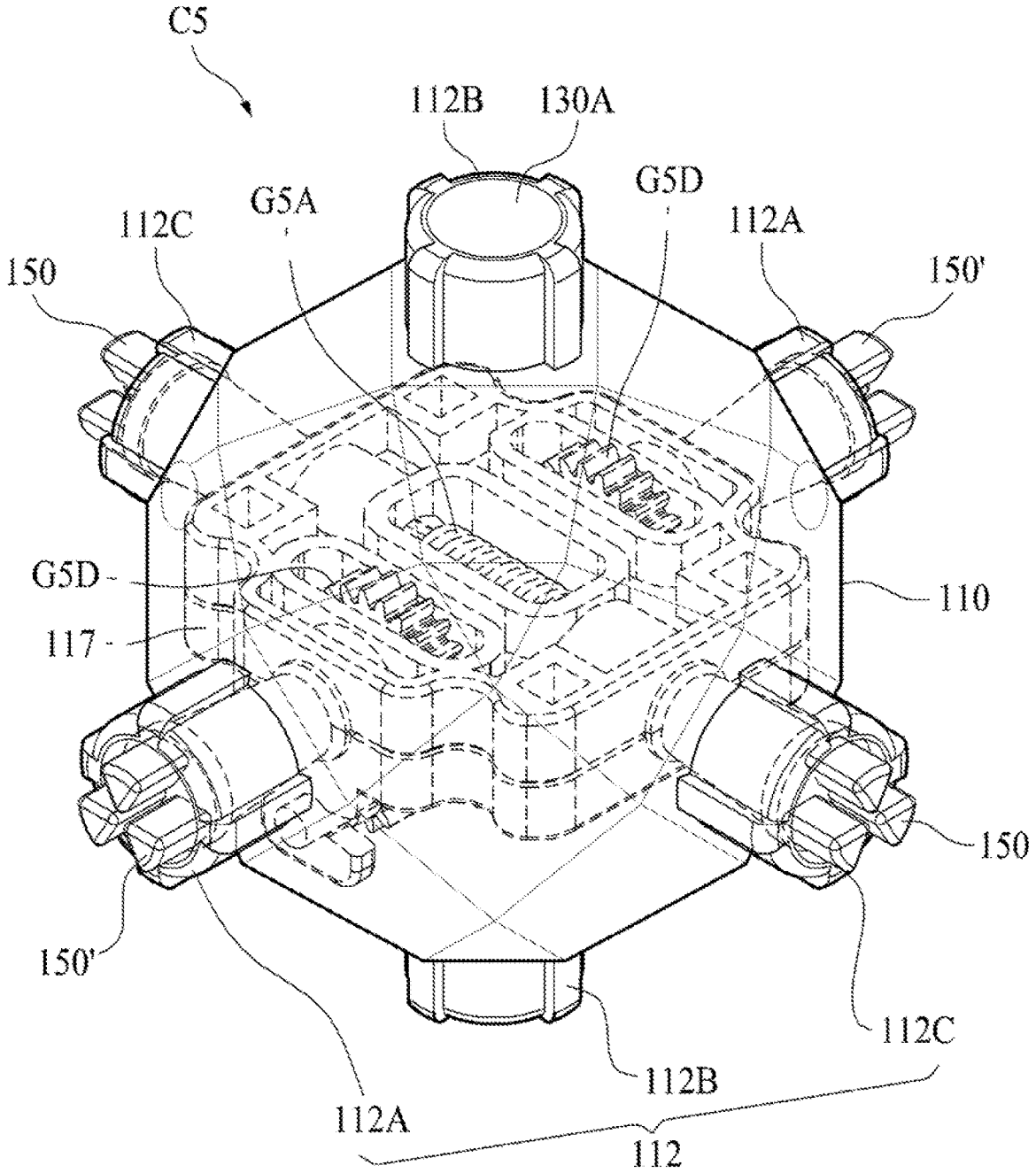
FIGS. 7A and 7B are perspective views of a power transmission apparatus to which a speed/direction change gear is applied, among the power transmission apparatuses according to the embodiment of the present invention.
Figure 7B:
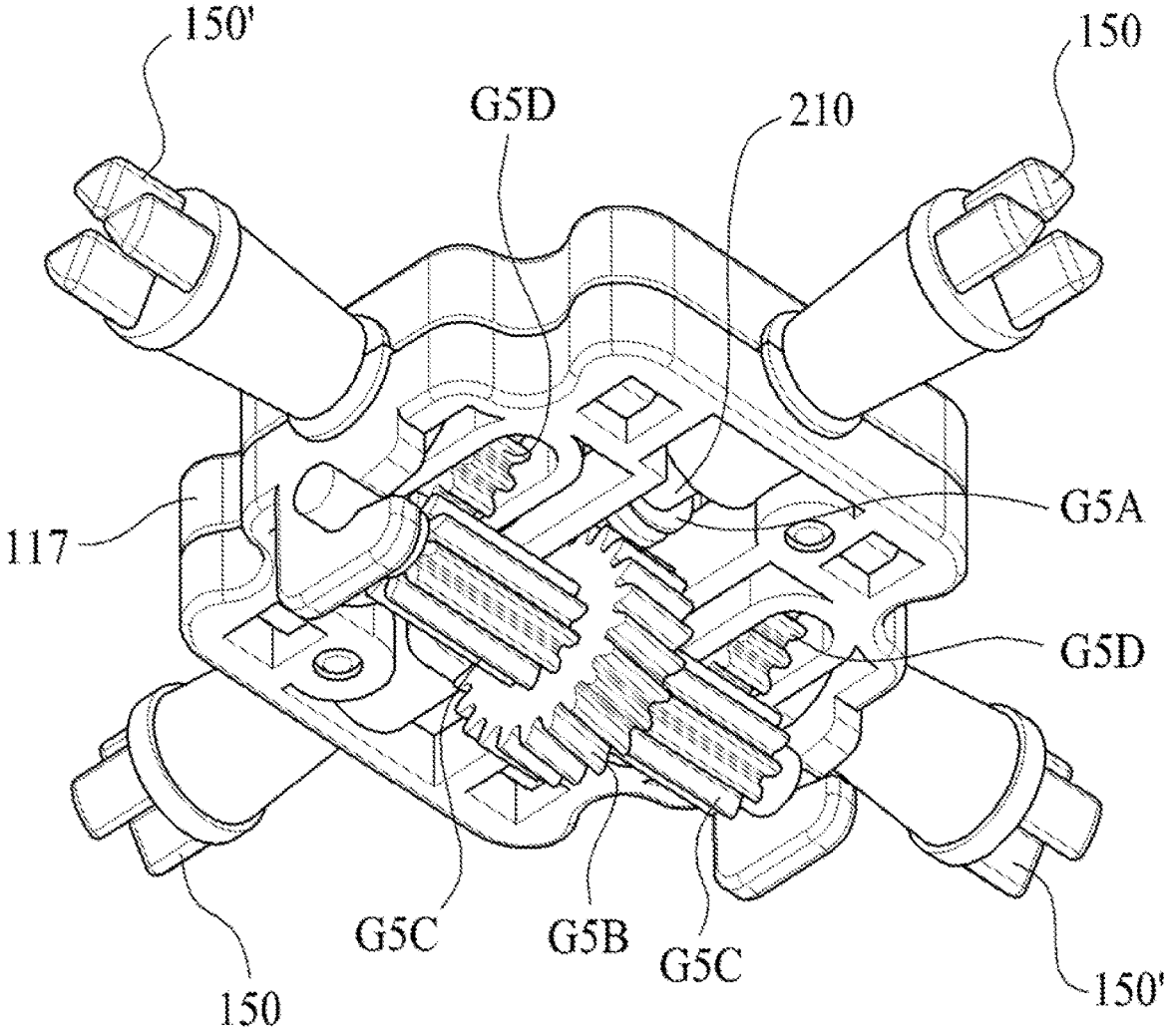

FIGS. 7A and 7B are perspective views of a power transmission apparatus C5 to which a speed/direction change gear is applied, among the power transmission apparatuses C according to the embodiment of the present invention.

The gear assembly 200 of the power transmission apparatus C5 includes a speed/direction change gear which raises or lowers the speed of transmitted power, and simultaneously changes an operation direction to a direction perpendicular thereto.

Specifically, as illustrated in FIG. 7B, the speed/direction change gear includes a worm gear part GSA, a direction change gear part G5D, and a connecting gear part G5B and G5C. The worm gear part G5A has a rotating shaft 210 which is extended in one direction and has both ends extended to a pair of connection holes facing each other, respectively, the direction change gear part G5D is installed at each of both connection holes in a direction perpendicular to the worm gear part GSA, and the connecting gear part G5B and G5C is divided into two parts which have different diameters and are engaged with the worm gear part GSA and the direction change gear part G5D, respectively, such that the worm gear part G5A and the direction change gear part G5D interwork each other.

That is, the connecting gear part G5B and G5C is rotated in connection with the rotation of the worm gear part GSA, and the direction change gear part G5D engaged with the connecting gear part G5B and G5C is rotated to change the direction. At this time, the connecting gear part G5B and G5C includes a first connecting part G5B having a relatively large diameter and a second connecting part G5C having a relatively small diameter. The first connecting part G5B is connected to the worm gear part GSA, and the second connecting part G5C is engaged with the direction change gear part G5D, in order to perform deceleration.

Figure 8A:
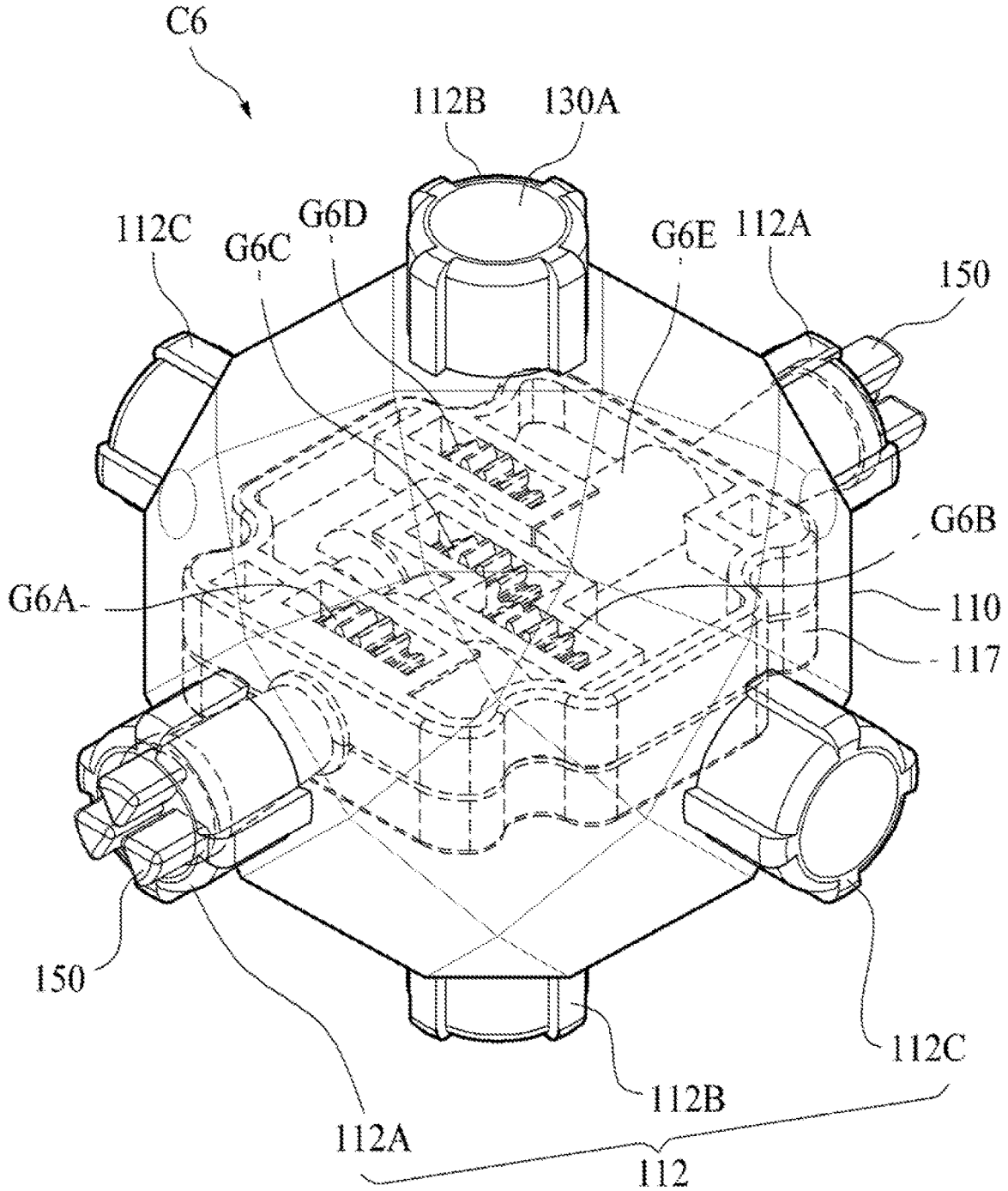
FIGS. 8A and 8B are perspective views of a power transmission apparatus C6 to which another example of the speed change gear is applied, among the power transmission apparatuses according to the embodiment of the present invention.
Figure 8B:
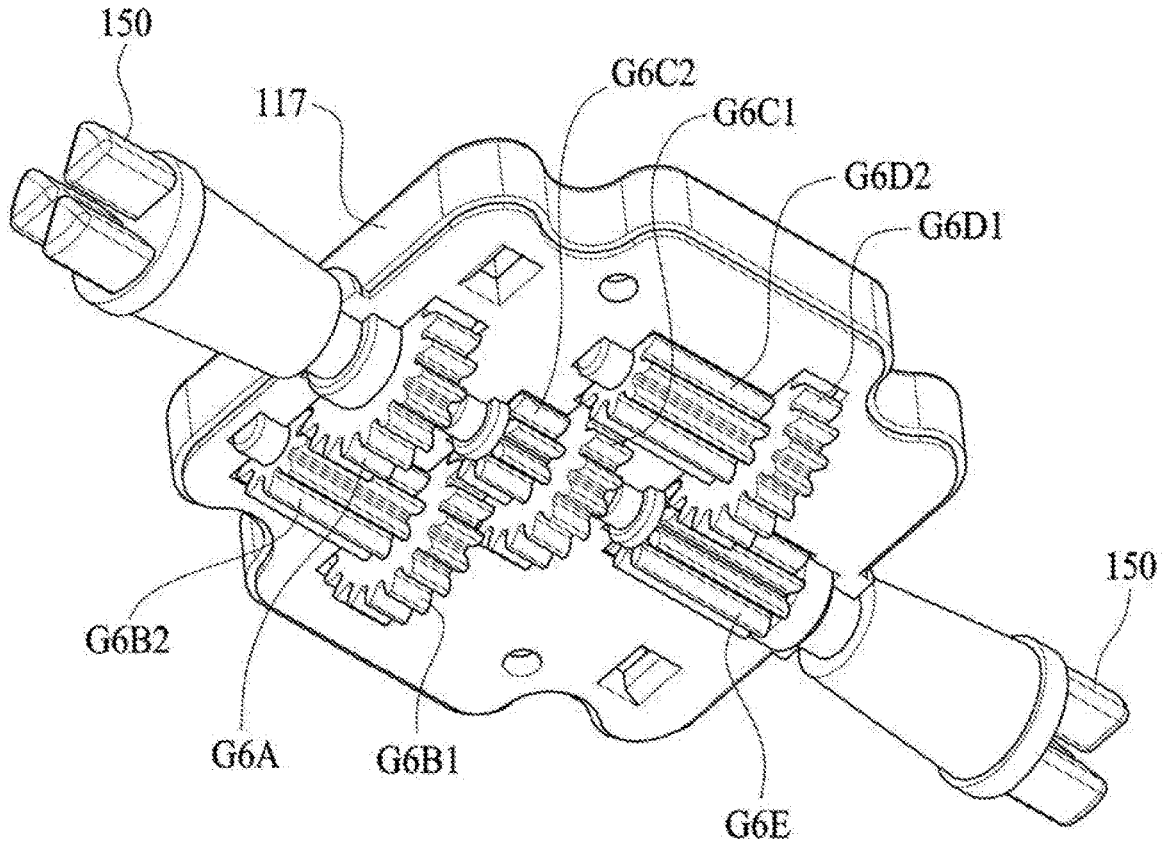

FIGS. 8A and 8B are perspective views of a power transmission apparatus C6 to which another example of the speed change gear is applied, among the power transmission apparatuses C according to the embodiment of the present invention.

The gear assembly 200 of the power transmission apparatus C6 includes a speed change gear which serves to raise or lower the speed of power transmitted from one side through a structure different from the embodiment of FIG. 6.

Specifically, the speed change gear includes a plurality of speed change gear parts G6B, G6C and G6D, and the speed change gear parts G6B, G6C and G6D include first operating parts G6B1, G6C1 and G6D1 which have a relatively large diameter and second operating parts G6B2, G6C2 and G6D2 which have a relatively small diameter while being rotated with the first operating parts G6B1, G6C1 and G6D1.

The first operating parts G6B1, G6C1 and G6D1 of the speed change gear parts G6B, G6C and G6D are engaged with second operating parts G6B2, G6C2 and G6D2 of counterpart speed change gear parts G6B, G6C and G6D which are engaged with the speed change gear parts G6B, G6C and G6D, and then rotated to sequentially lower the speed of power.

In the present embodiment, a total of three speed change gear parts G6B, G6C and G6D are installed, and an introduction gear part G6A and a transmission gear part G6E are installed at both sides of the speed change gear parts G6B, G6C and G6D.

Figure 9:
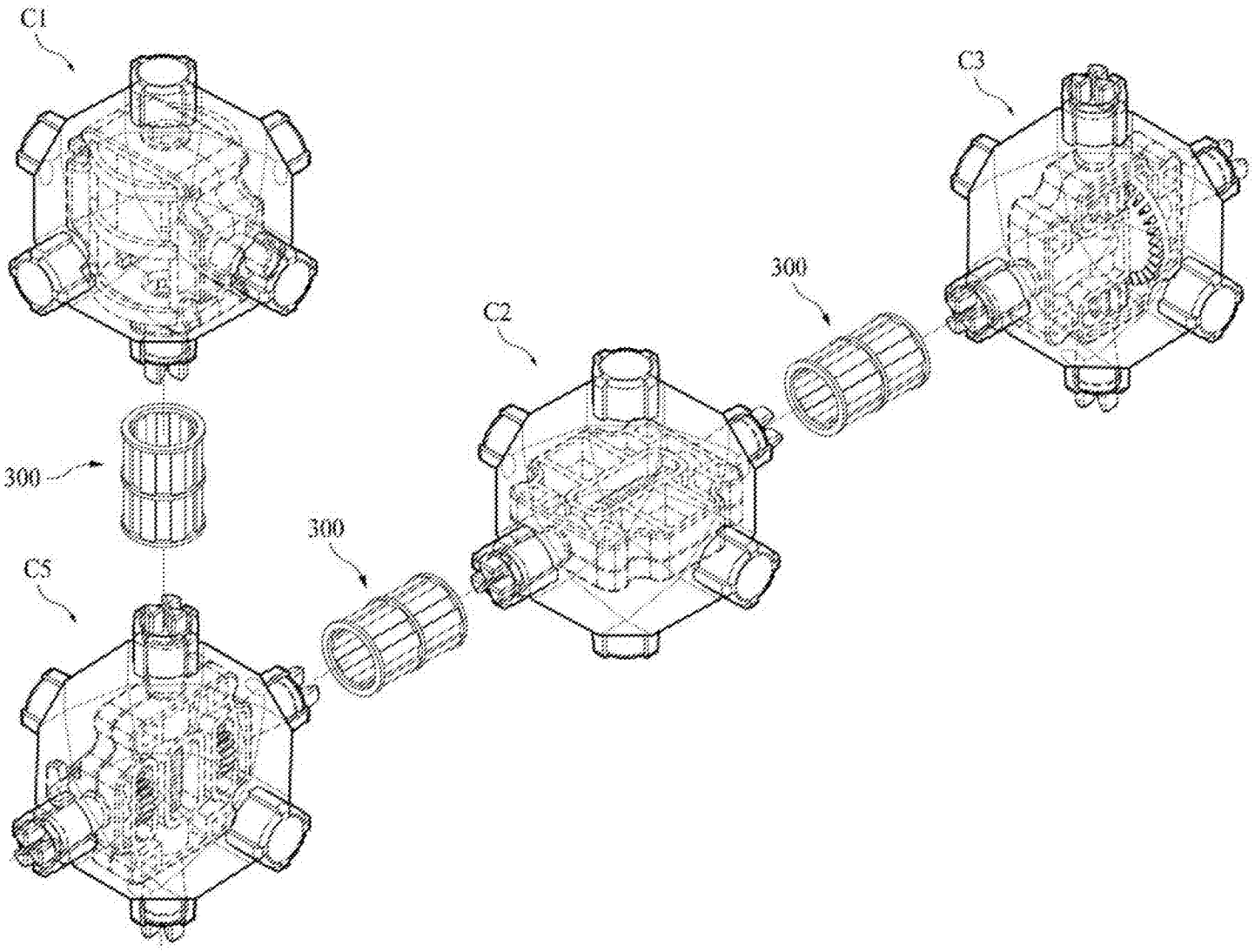
FIG. 9 illustrates an example in which the power transmission apparatuses according to the embodiment of the present invention are connected to each other.

FIG. 9 illustrates an example in which power transmission apparatuses according to the embodiment of the present invention are connected to each other.

As illustrated in FIG. 9, a plurality of power transmission apparatuses C are connected to transmit power from one side to the other side. Since one power transmission apparatus C has a plurality of connection holes formed therein, the power transmission apparatus C can be coupled in various directions.

Furthermore, a user can arbitrarily select the type of the power transmission apparatus C in order to use a variety of applications. FIG. 9 illustrates an example in the power transmission apparatus C3 with the speed switching gear is connected to the driving device C1, the power transmission apparatus C2 with the extending gear is connected to the power transmission apparatus C3, and the power transmission apparatus C5 with the speed/direction change gear is connected to the power transmission apparatus C2.

The power transmission apparatuses C may be simply and easily coupled through the coupling tubes 300 such that the gears thereof are accurately engaged with each other. Furthermore, the power transmission apparatuses C may be reliably press-fitted and coupled to each other through the coupling tubes 300.

Figure 10:
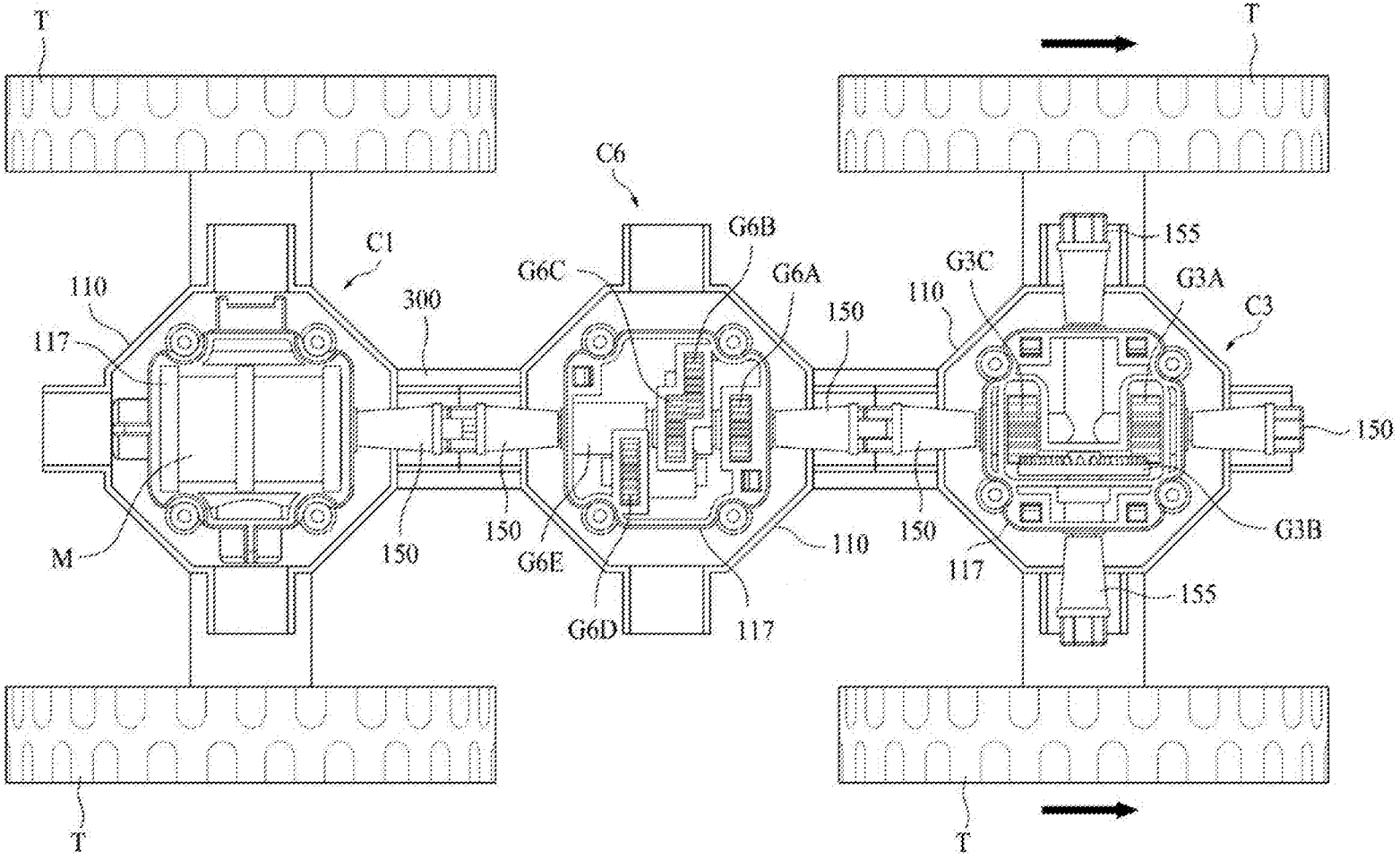
FIG. 10 is a plan view illustrating the configuration of a built-up type toy including power transmission apparatuses according to an embodiment of the present invention.

FIG. 10 is a plan view illustrating the configuration of a built-up type toy including power transmission apparatuses according to an embodiment of the present invention.

As illustrated in FIG. 10, the built-up type toy can transmit power to a distance in various manners through the power transmission apparatuses C. For example, the built-up type toy can be implemented as a model car using the power transmission apparatuses C and wheels T. Furthermore, a timing belt (not illustrated) may be used to implement a variety of mechanisms.

FIG. 10 illustrates a model car including one driving device C1 and two power transmission apparatuses C6 and C3. The power transmission apparatuses C6 and C3 include the power transmission apparatus C6 with the extending gear and the power transmission apparatus C3 with the direction change gear, and are coupled to each other through the coupling tube 300.

The power transmission apparatus C3 with the direction change gear includes wheels T which are rotated by torque received from the driving device C1, thereby implementing a kind of model car.

While various embodiments have been described above, it will be understood to those skilled in the art that the embodiments described are by way of example only. Accordingly, the disclosure described herein should not be limited based on the described embodiments.

INDUSTRIAL APPLICABILITY

The present invention relates to a power transmission apparatus for transmitting power between components and a built-up type toy including the same. The power transmission apparatuses for transmitting power include independent housings and have functions such as change of direction and deceleration. Since the power transmission apparatuses can be simply coupled to each other so as to implement various function and applications, even young users can easily create a power transmission structure, which makes it possible to improve the range of utilization.

The invention claimed is:

1. A power transmission apparatus for transmitting power between components, comprising:

a housing including a first housing part and a second housing part coupled together and an operating space between the first housing part and the second housing part, at least one connection protrusion portion extending from one or more sides of the housing and having a connection hole;

a gear assembly provided in the operating space of the housing and including at least one gear and at least one connecting link, the connecting link exposed to an outside of the housing through the connection hole and coupled to an end of the gear;

an inner housing fastened in the operating space and configured to support and fasten a gear shaft of the at least one gear of the gear assembly; and a coupling tube fitting over the connection protrusion portion and configured to couple respective connection holes of the power transmission apparatus and a second power transmission apparatus, a plurality of press-fitting ribs protruding from an inner surface of the coupling tube, spaced apart from each other at predetermined intervals, and shaped as substantially rectangular bars to enable the at least one connection protrusion portion to be reliably press-fitted and fixed to an inside of the coupling tube, wherein the connecting link includes a plurality of elastic fingers elastically and press-fittingly connected with corresponding elastic fingers of a second power transmission apparatus through the connection hole, wherein the at least one gear of the gear assembly includes an extending gear configured to transmit power in a first direction of the gear, a direction change gear configured to change a direction of the transmitted power from the first direction to a direction perpendicular to the first direction, a speed change gear configured to change a speed of the transmitted power, or a speed/direction change gear configured to change the speed and direction of the transmitted power, and the inner housing having a uniform outer shape and an interior partitioned to provide a separate compartment for each gear included in the gear assembly.

2. The power transmission apparatus of claim 1, wherein the housing and the gear assembly are formed of a transparent or translucent material including a synthetic resin.

3. The power transmission apparatus of claim 1, wherein the first housing part and the second housing part have fastening holes formed in positions corresponding to each other, and wherein the first housing part and the second housing part are coupled to each other through a fastener inserted through the fastening holes.

4. The power transmission apparatus of claim 2, wherein the housing is formed in a substantially spherical shape, wherein the housing includes a second connection protrusion portion, and wherein the connection protrusion portion and the second connection protrusion portion are formed to extend in two directions chosen from among a front direction, a rear direction, a left direction, a right direction, an upper direction, and a lower direction while the connection protrusion portion and the second connection protrusion portion form a pair.

5. The power transmission apparatus of claim 1, wherein the inner housing comprises a first inner housing part and a second inner housing part coupled to each other with the gear assembly interposed therebetween.

6. The power transmission apparatus of claim 1, wherein the gear assembly includes the extending gear which comprises:

a rotating shaft having both ends extending toward two opposite connection holes of the at least one connection holes of the housing and wherein two connecting links of the at least one connecting link are installed at both ends of the rotating shaft.

7. The power transmission apparatus of claim 1, wherein the gear assembly includes the direction change gear which comprises:

a pair of driving gear parts installed in two opposite connection holes of the at least one connection hole of the housing; and a driven gear part engaged with the pair of driving gear parts and having a rotating shaft perpendicular to the pair of driving gear parts, wherein the rotating shaft of the driven gear part extends in a direction perpendicular to a virtual extension line connecting the pair of driving gear parts, such that both ends thereof extend toward separate connection holes.

8. The power transmission apparatus of claim 1, wherein the gear assembly includes the speed change gear which comprises:

a first gear part;

a second gear part engaged and rotated with the first gear part; and a third gear part having gear teeth formed along an inner circumferential surface thereof such that the second gear part is inscribed in the third gear part, wherein the first gear part extends to any one of the at least one connection hole of the housing, and the third gear part extends to an opposite connection hole of the connection hole to which the first gear part extends.

9. The power transmission apparatus of claim 1, wherein the gear assembly includes the speed change gear which comprises a plurality of speed change gear parts, wherein the speed change gear parts comprise a first operating part having a relatively larger diameter and a second operating part having a relatively smaller diameter and rotating with the first rotating part, and wherein the first operating part of the speed change gear is engaged and rotated with a second operating part of a counterpart speed change gear which is engaged with the speed change gear.

10. The power transmission apparatus of claim 1, wherein the gear assembly includes the speed/direction change gear which comprises:

a worm gear part extending in one direction and having both ends extending to two opposite connection holes of the at least one connection hole;

a direction change gear part installed in each of the two opposite connection holes in a direction perpendicular to the worm gear part; and a connecting gear part divided into two parts having different diameters and engaged with the worm gear part and the direction change gear part such that the worm gear part and the direction change gear part interwork with each other.

11. A toy, comprising:

a driving device including a motor;

a power transmission apparatus connected to the driving device; and a rotating part connected to the power transmission apparatus and rotated by the power transmission apparatus, wherein the power transmission apparatus is configured to receive a torque from the motor and transmit the received torque to the rotating part, wherein the power transmission apparatus comprises:

a housing including a first housing part and a second housing part coupled together and an operating space between the first housing part and the second housing part, at least one connection protrusion portion extending from one or more sides of the housing and having a connection hole;

a gear assembly provided in the operating space of the housing and including at least one gear and at least one connecting link, the connecting link exposed to an outside of the housing through the connection hole and coupled to an end of the gear;

an inner housing fastened in the operating space and configured to support and fasten a gear shaft of the at least one gear of the gear assembly; and a coupling tube fitting over the connection protrusion portion and configured to couple respective connection holes of the power transmission apparatus and a second power transmission apparatus, a plurality of press-fitting ribs protruding from an inner surface of the coupling tube, spaced apart from each other at predetermined intervals, and shaped as substantially rectangular bars to enable the at least one connection protrusion portion to be reliably press-fitted and fixed to an inside of the coupling tube wherein the connecting link includes a plurality of elastic fingers elastically and press-fittingly connected with corresponding elastic fingers of a second power transmission apparatus through the connection hole, wherein the at least one gear of the gear assembly includes an extending gear configured to transmit power in a first direction of the gear, a direction change gear configured to change a direction of the transmitted power from the first direction to a direction perpendicular to the first direction, a speed change gear configured to change a speed of the transmitted power, or a speed/direction change gear configured to change the speed and direction of the transmitted power, and the inner housing having a uniform outer shape and an interior partitioned to provide a separate compartment for each gear included in the gear assembly.

12. The toy of claim 11, wherein the housing and the gear assembly are formed of a transparent or translucent material including a synthetic resin.

13. The toy of claim 12, wherein the first housing part and the second housing part have fastening holes formed in positions corresponding to each other and are coupled to each other through a fastener inserted through the fastening holes.

14. The toy of claim 11, wherein the housing is formed of a transparent or translucent material in a spherical shape, and wherein two connection protrusion portions of the at least one connection protrusion portion is formed to extend in two or more directions chosen from among a front direction, a rear direction, a left direction, a right direction, an upper direction, and a lower direction while the two connection protrusion portions form a pair.

* * * * *